US011592254B2

(12) United States Patent
Cheng

(10) Patent No.: US 11,592,254 B2
(45) Date of Patent: Feb. 28, 2023

(54) BOLT CATCH DEVICE FOR FIREARMS

(71) Applicant: KRISS INDUSTRIES ASIA LTD., New Taipei (TW)

(72) Inventor: Li-Te Cheng, New Taipei (TW)

(73) Assignee: KRISS INDUSTRIES ASIA LTD., New Taipei (TW)

( * ) Notice: Subject to any disclaimer, the term of this patent is extended or adjusted under 35 U.S.C. 154(b) by 0 days.

(21) Appl. No.: 17/518,970

(22) Filed: Nov. 4, 2021

(65) Prior Publication Data

US 2022/0373282 A1 Nov. 24, 2022

(30) Foreign Application Priority Data

May 20, 2021 (TW) ..... 110118324

(51) Int. Cl.
*F41A 17/36* (2006.01)

(52) U.S. Cl.
CPC ..... *F41A 17/36* (2013.01)

(58) Field of Classification Search
CPC ..... F41A 17/36; F41A 17/34; F41A 17/40
See application file for complete search history.

(56) References Cited

U.S. PATENT DOCUMENTS 7,219,462 B2 * 5/2007 Finn ..... F41A 17/38 89/33.1
7,661,219 B1 * 2/2010 Knight, Jr. ..... F41A 3/42 89/138
8,479,635 B2 * 7/2013 Overstreet ..... F41A 9/70 89/181
9,557,125 B2 * 1/2017 Stewart ..... F41A 17/36
10,228,201 B2 * 3/2019 Walther ..... F41A 35/06
10,401,102 B1 * 9/2019 Carroll ..... F41A 3/66
11,112,192 B2 * 9/2021 Herring ..... F41A 3/66
11,175,108 B1 * 11/2021 Lee ..... F41A 17/42
11,287,204 B2 * 3/2022 Davidson ..... F41A 17/36
2010/0275485 A1 * 11/2010 Findlay ..... F41A 35/06 42/16
2012/0167424 A1 * 7/2012 Gomez ..... F41A 35/06 42/14
2013/0014416 A1 * 1/2013 Sisgold ..... F41A 9/66 42/17

FOREIGN PATENT DOCUMENTS

EP 3722732 A1 * 10/2020

* cited by examiner

*Primary Examiner* — Jonathan C Weber
(74) *Attorney, Agent, or Firm* — Locke Lord LLP; Tim Tingkang Xia, Esq.

(57) ABSTRACT

A bolt catch device for firearms, which is connected to a lower housing and includes a linkage portion and a release portion. The linkage portion is connected to the lower housing by a first pivot shaft and has an abutting member. The release portion is connected with the lower housing by a second pivot shaft, and has a pin and a bolt catch. When the user uses the trigger finger to move the bolt catch, the bolt catch performs a rotational displacement movement from a first position with the second pivot shaft as the center, so that the bolt catch is located at the second position. The abutting member performs a rotational displacement movement centered on the first pivot shaft, and the abutting member is away from the bolt, and the bolt moves to complete the feeding of the ammunition.

11 Claims, 8 Drawing Sheets

BOLT CATCH DEVICE FOR FIREARMS

CROSS-REFERENCE TO RELATED APPLICATION

This application claims priority of Taiwanese Application No. 110118324, filed on May 20, 2021, which is incorporated by reference herein in its entirety.

BACKGROUND OF THE INVENTION

Field of the Invention

The present invention relates to firearms, and in particular to a bolt catch device for releasing a bolt catch state of a gun with one hand, which can be applied to various types of firearms.

Description of the Prior Art

Currently, the term automatic rifle refers to a rifle with automatic bullet feeding, continuous firing, and fully automatic shooting capabilities. Some rifles can use part of the gas or recoil force of the advancing ammunition to eject the shell, reload and fire again, that is, as long as the trigger is held down, it can fire continuously until the bullets in the gun are exhausted.

The commonly known gas blowback rifle that is abbreviated as GBBR can shoot ammunition and simulate the reciprocating motion and recoil force of a real gun. It also has the function and settings of a gun.

After setting the function without using bullets, for users, it is necessary to replace the exhausted magazine and release the fixed state of the bolt before the shooting action can be continued. When performing the aforementioned replacement of the exhausted magazine action, the user's hand is holding the grip of the gun, and the trigger finger is moved to press the magazine latch on the side of the gun to release the magazine, then the other hand replaces with the new magazine, and the other hand is used to release the gun bolt on the other side of the gun from the bolt catch state so that the gun can be loaded.

Although the simulated rifle does not have the bolt catch function of a gun using bullets, there are some problems in the general design. For example, the bolt catch action is inaccurate or the durability of the bolt catch parts are insufficient and easily malfunction. Additionally, the production cost of the bolt catch parts is high, causing manufacturer and user inconvenience.

In addition, today's series of functions all need to be completed with both hands. Every second is counted on the battlefield or in the game. If there is a slight delay, you may lose your life, but it may also be the key to victory. Therefore, how to quickly change the magazine, and release the bolt catch state after no ammunition is really an important issue.

SUMMARY OF THE INVENTION

In view of the foregoing shortcomings, one of the objectives of the present invention is to speed up the user's release of the bolt after the fixed state, after replacing the exhausted magazine, the release of the bolt is accomplished with one hand and the state of the gun is set and the loading of the gun is completed, and the user continues to shoot with both hands.

The present invention provides a bolt catch device for firearms, which is connected to a lower housing and is located in a moving direction of the bolt, and includes a linkage portion and a release portion. The linkage portion is connected with the lower casing by a first pivot shaft, and performs a first rotational displacement movement by the first pivot shaft. The linkage portion has an abutting member. The releasing portion is connected with the lower housing by a second pivot shaft, and the releasing portion has a pin and a bolt catch, and two ends of the pin are respectively connected with the bolt catch and the linkage portion. The abutting member performs the first rotational displacement movement and is located in the moving direction of the bolt, and the bolt abuts against the abutting member. At the same time, the bolt catch performs a second rotational displacement movement with the second pivot shaft and then remains in a bolt catch position. Subsequently, the bolt catch is shifted and performs a third rotational displacement movement with the second pivot shaft from the bolt catch position to a release position. The abutting member performs with the first pivot shaft at the same time a fourth rotational displacement movement. The abutting member leaves the bolt with the fourth rotational displacement movement, and the bolt moves to complete the feeding of the ammunition.

Further, the linkage portion includes a frame body and a linkage device. The frame body includes a first connecting portion and the abutting member. The first connecting portion is located at one end of the frame body and is connected to the lower housing by the first pivot shaft. The abutting member is located on another end of the frame body, and the abutting member has a hole. The linkage device is located in a containing groove of the lower housing and abuts against the abutting member. The linkage device includes a convex portion and a second connecting portion, and the convex portion extends into the hole from one end of the linkage device, and the second connecting portion is connected with the lower housing by a third pivot shaft.

Further, the second connecting portion further includes a through hole, and the release portion is located in the through hole through the pin. The bolt catch and the linkage device are synchronized and linked. The abutting member performs the first rotational displacement movement, meanwhile, the convex portion performs a fifth rotational displacement movement centered on the third pivot shaft. The bolt catch performs the third rotational displacement movement. At the same time, the convex portion performs a sixth rotational displacement movement centered on the third pivot shaft.

Further, the abutting member performs the first rotational displacement movement to a position where the bolt abuts against. At the same time, the bottom of the inner edge of the hole abuts against the convex portion, and the convex portion performs the fifth rotational displacement movement, so that the convex portion abuts against the top of the inner edge of the hole. At the same time, the through hole performs the fifth rotational displacement movement, and the bottom of the inner edge of the through hole abuts against the pin, so that the pin performs rotational displacement movement. At the same time, the bolt catch performs the second rotational displacement movement to the bolt catch position.

Further, the bolt catch performs the third rotational displacement movement from the bolt catch position to the release position, and the pin performs rotational displacement movement, and then the pin abuts against the bottom of the inner edge of the through hole. At the same time, the through hole and the convex portion perform the sixth rotational displacement movement, so that the convex portion abuts against the bottom of the inner edge of the hole. At the same time, the hole and the abutting member perform the fourth rotational displacement movement, and the abutting member releases the bolt.

In addition, in one embodiment, the bolt catch is connected to one end of the second pivot shaft, or the bolt catch is connected to the two ends of the second pivot shaft respectively.

Further, the release portion further includes a screw, and the bolt catch further has a first hole. One end of the second pivot shaft is located in the first hole, and the screw fastens the bolt catch and the second pivot shaft in the first hole.

In another embodiment, the linkage device further includes a stabilizing member fixed to the bottom of the linkage device, and the stabilizing member abuts against the second pivot shaft. When the lower housing lies on a side, the stabilizing member stabilizes the convex portion in the hole, preventing the abutting member of the frame body from abutting against the bolt.

Further, the stabilizing member includes a main body, an elastic element, and a lever, and the top of the body is connected to the bottom of the linkage device. One end of the lever is pivoted to the main body, and the elastic element is connected between the main body and the lever. The lever abuts against the rotating shaft.

Furthermore, the stabilizing member further includes at least one locking element, and the locking element fixes the main body to the bottom of the linkage device.

The elastic element is, for example, a tension spring, a compression spring, a torsion spring or a low-damping shock absorber.

In summary, the advantages of the present invention are as follows:

The bolt catch device for firearms of the present invention only needs to use the hand holding the grip of the gun to move the trigger finger after replacing the exhausted magazine, and at the same time complete the release of the bolt catch state of the gun, and the gun returns to the loaded ammunition state and the ammunition can be fired.

With the stabilizing member, the bolt catch device for firearms of the present invention can be used at a special angle. For example, when the user rolls or tilts to shoot, the frame body will not rotate on its own, making the abutting member hinder the operation of the bolt, causing the bolt to be set back.

DESCRIPTION OF THE PREFERRED EMBODIMENTS

In order to make the objectives, technical solutions, and advantages of the present invention clearer, the following describes the present invention in further detail with reference to the accompanying drawings and embodiments. It should be understood that the specific embodiments described here are only used to explain the present application, and are not used to limit the present invention.

Figure 1:
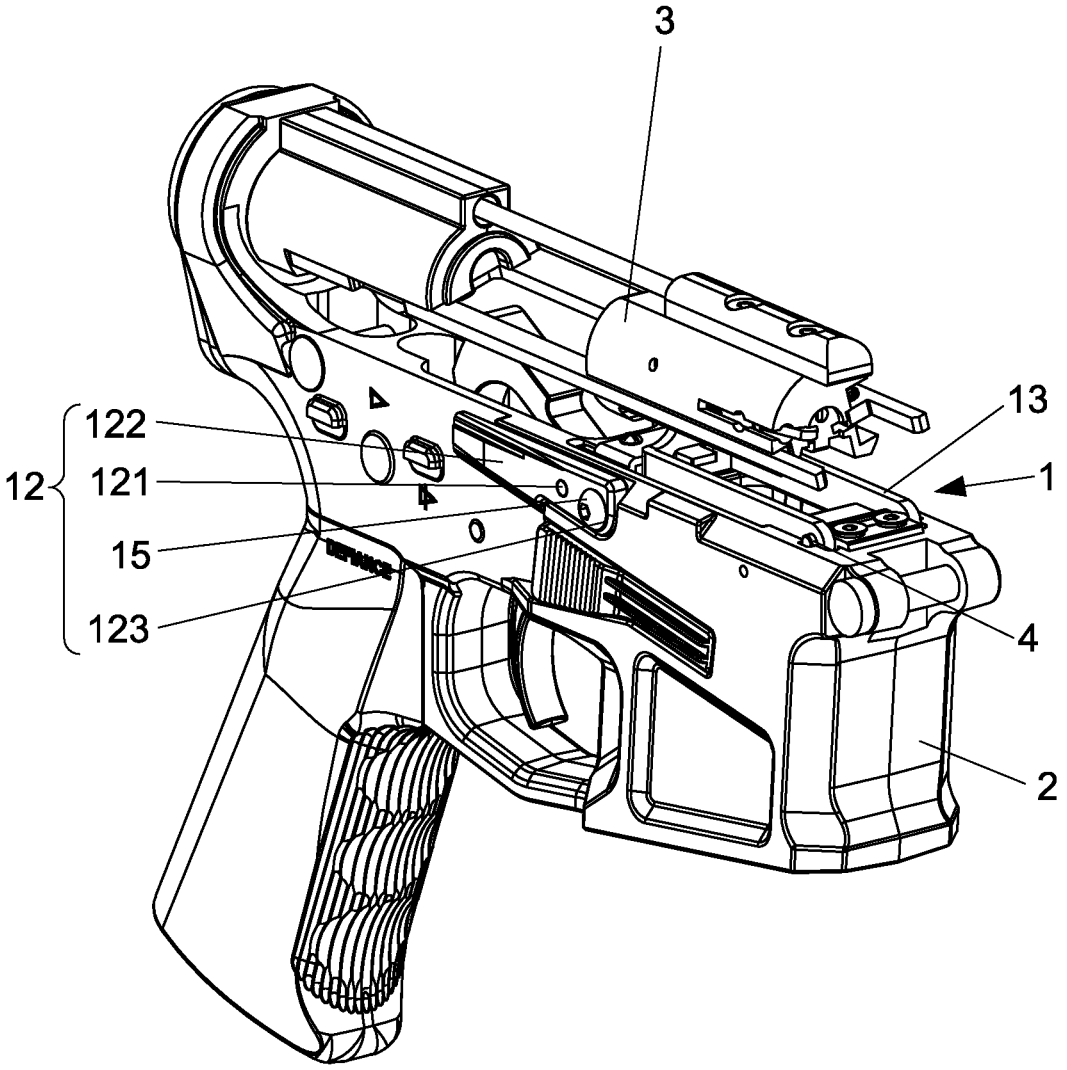
FIG. 1 is a three-dimensional schematic diagram of the bolt catch device and the lower housing of the present invention.
Figure 2:
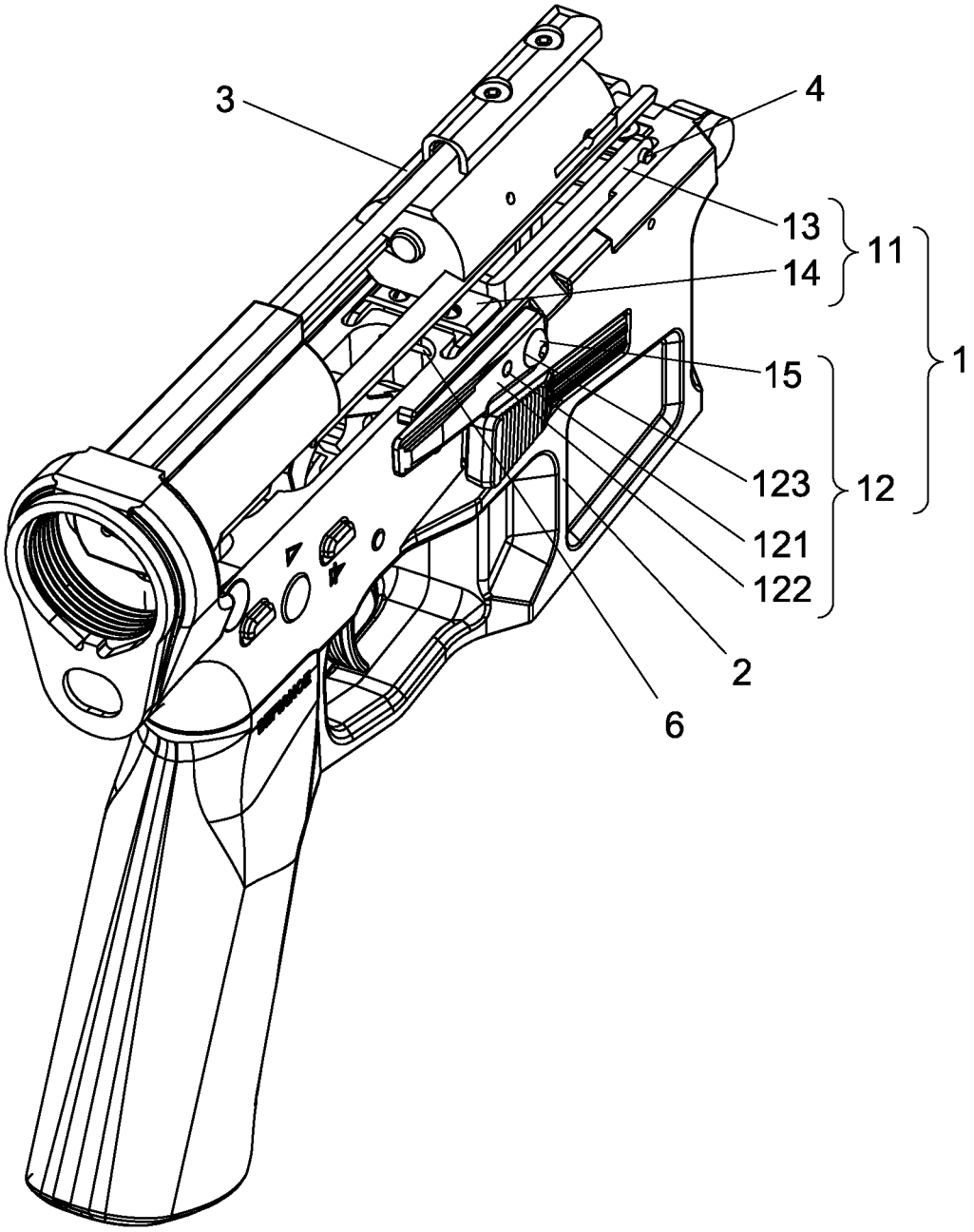
FIG. 2 is a three-dimensional schematic diagram of the bolt catch device and the lower housing of the present invention from another perspective.

Please refer to FIG. 1 and FIG. 2. FIG. 1 is a three-dimensional schematic diagram of the bolt catch device and the lower receiver of the present invention. FIG. 2 is a three-dimensional schematic diagram of the bolt catch device and the lower receiver of the present invention from another perspective. The present invention provides a bolt catch device 1 which is connected to the lower housing 2 and is located in the moving direction of a bolt 3. The bolt catch device 1 includes a linkage portion 11 and a release portion 12.

The linkage portion 11 is connected with the lower housing 2 by a first pivot shaft 4, and performs a first rotational displacement movement 91 by the first pivot shaft 4, and the linkage portion 11 has an abutting member 132.

The release portion 12 is connected to the lower housing 2 by a second pivot shaft 5, and the release portion 12 has a pin 121 and a bolt catch 122. Both ends of the pin 121 are respectively connected to the bolt catch 122 and the linkage portion 11. The bolt catch 122 may be connected to one end of the second pivot shaft 5. Alternatively, the bolt catch 122 may be respectively connected to the two ends of the second pivot shaft 5. Preferably, in this embodiment, the bolt catch 122 is respectively connected to two terminals of the second pivot shaft 5 for example.

Figure 3:
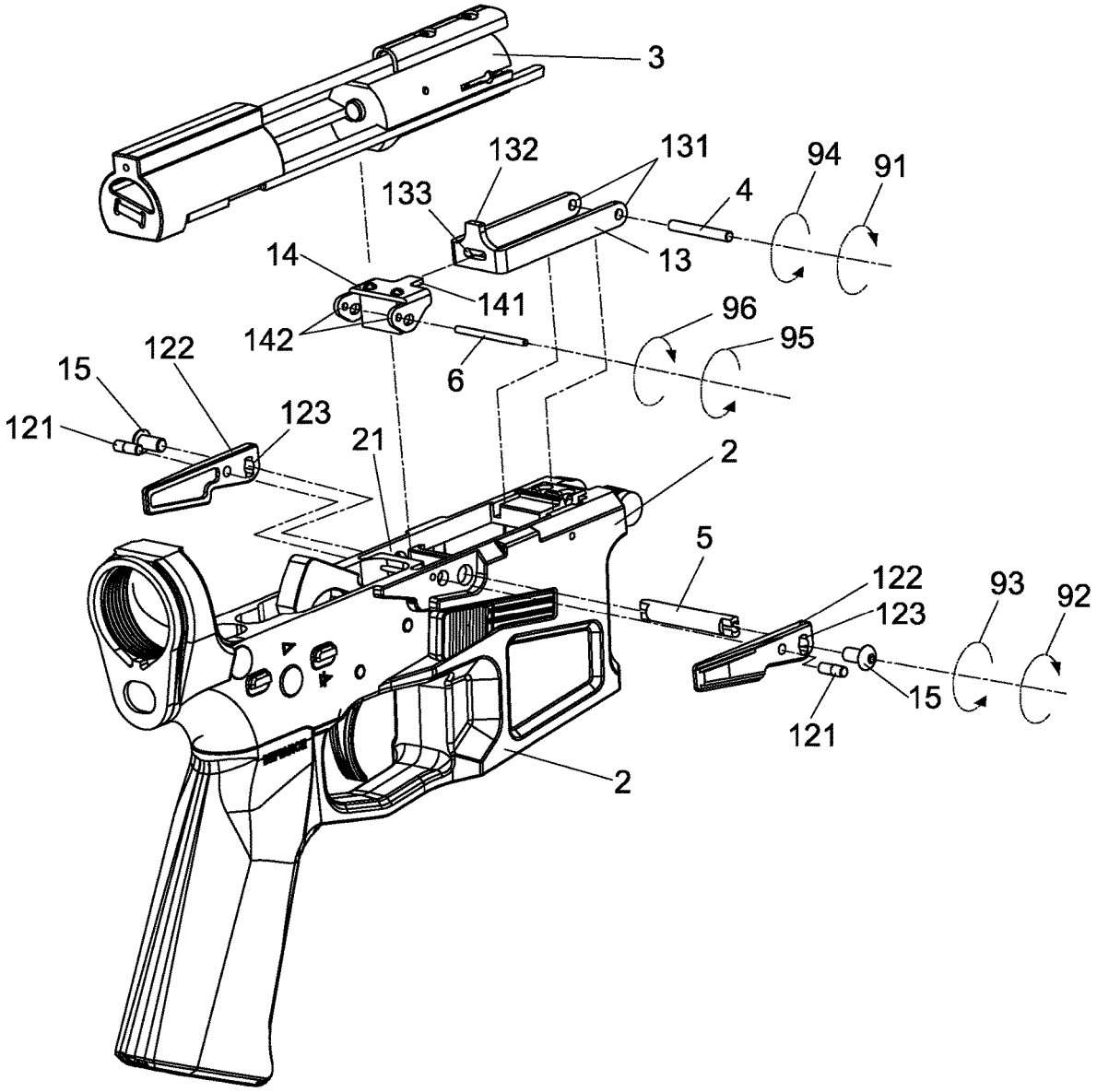
FIG. 3 is a three-dimensional exploded schematic view of the bolt catch device and the lower housing of the present invention.

Additionally, refer to FIG. 3, which illustrates a rear perspective view of the present invention of a given receiver means and the schematic exploded. In this embodiment, the linkage portion 11 includes a frame body 13 and a linkage device 14.

The frame body 13 includes a first connecting portion 131 and an abutting member 132. The first connecting portion 131 is located at one end of the frame body 13 and is connected to the lower housing 2 by the first pivot shaft 4. The abutting member 132 is located at the other end of the frame body 13 and the abutting member 132 also has a hole 133.

An interlocking device 14 is located in an accommodating groove 21 of the lower housing 2 and abuts against the abutting member 132. The interlocking device 14 includes a convex portion 141 and a second connecting portion 142. The convex portion 141 extends from one end of the linkage device 14 into the hole 133, and the second connecting portion 142 is connected to the lower housing 2 by a third pivot shaft 6.

In addition, in the preferred embodiment, the release portion 12 further includes a screw 15, and the bolt catch 122 further has a first hole 123. One end of the second pivot shaft 5 is located in the first hole 123. The screw 15 fastens the bolt catch 122 and the second pivot shaft 5 in the first hole 123.

The second connecting portion 142 further includes a through hole 143, and the release portion 12 is disposed in the through hole 143 with the pin 121 for interlocking synchronization of the bolt catch 122 and the linkage device 14.

That is, when the abutting member 132 performs the first rotational displacement movement 91, at the same time, the convex portion 141 performs a fifth rotational displacement movement 95 with the third pivot shaft 6 as the center. When the bolt catch 122 performs a third rotational displacement movement 93 centered on the second pivot shaft 5, at the same time, the convex portion 141 performs a sixth rotational displacement movement 96 centered on the third pivot shaft 6.

In addition, it should be further explained that in this embodiment, the size, shape and position of the linkage portion 11 and the release portion 12 are set in accordance with the specifications of the gun. In the actual implementation of the present invention, the linkage portion 11, and the size and shape of the release part 12 will be made and set up according to the specifications of various guns, so all those that have the same connection and action relationship as the interlocking linkage portion 11 and the release portion 12 of the present invention belong to the scope of the present invention.

Figure 4:
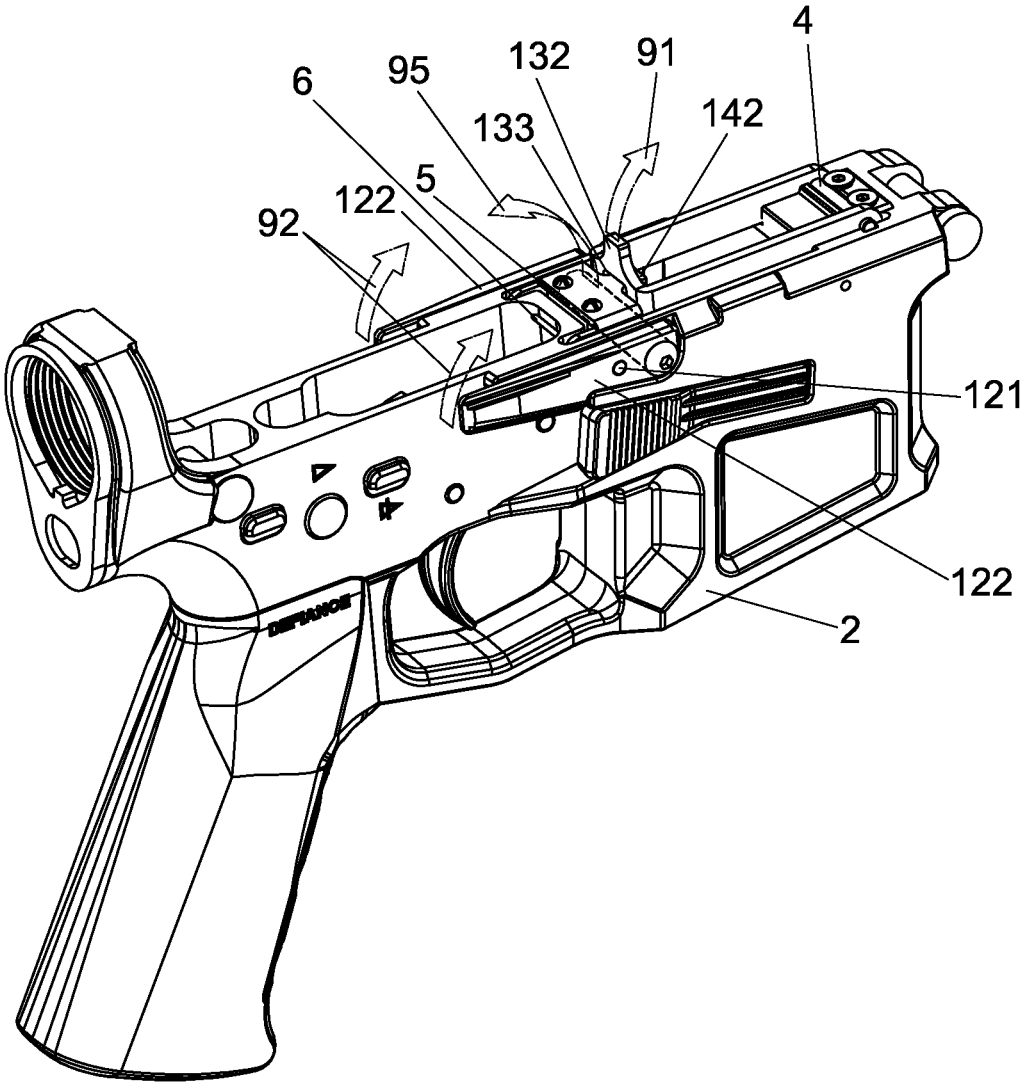
FIG. 4 is a schematic diagram of the bolt catch action of the bolt catch device of the present invention.
Figure 5:
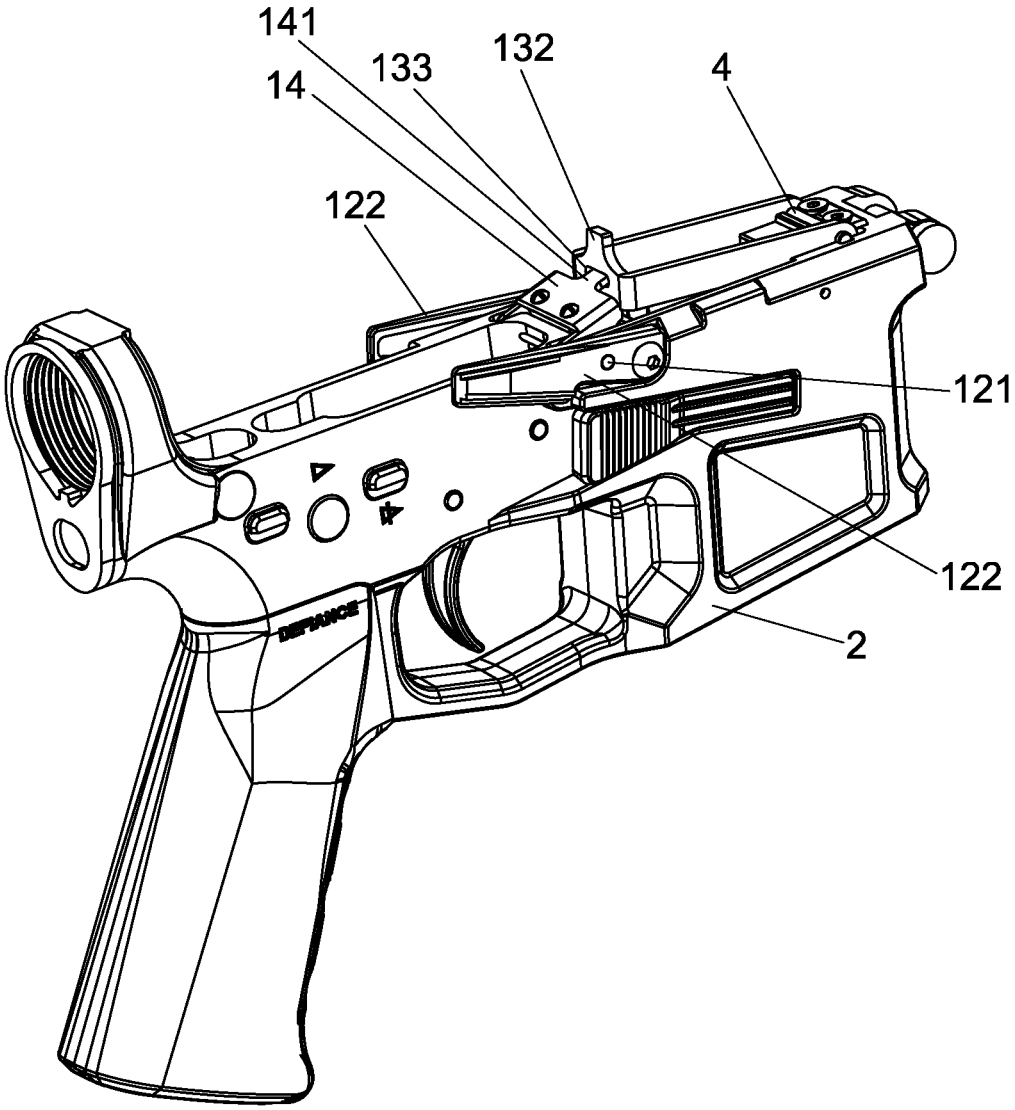
FIG. 5 is a schematic diagram of the bolt catch state of the bolt catch device of the present invention.

Please refer to FIGS. 4 and 5. FIG. 4 is a schematic diagram of the bolt catch action of the bolt catch device of the present invention. FIG. 5 is a schematic diagram of the bolt catch state of the bolt catch device of the present invention. In the above, when the abutting member 132 performs the first rotational displacement movement 91 and is located in the moving direction of the bolt 3, the bolt 3 abuts against the abutting member 132. At the same time, the bolt catch 122 performs a second rotational displacement movement 92 with the second pivot shaft 5 and then remains in a bolt catch position.

It is further explained that the abutting member 132 performs the first rotational displacement movement 91 at the abutting position of the bolt 3, and at the same time, the bottom of the inner edge of the hole 133 abuts the convex portion 141.

The convex portion 141 is centered on the third pivot shaft 6 while performing the fifth rotational displacement movement 95, so that the convex portion 141 abuts against the top of the inner edge of the hole 133, and also makes the abutting member 132 accurately located in the moving direction of the bolt 3. At the same time, the through hole 143 also performs the fifth rotational displacement movement 95 centered on the third pivot shaft 6; the bottom of the inner edge of the through hole 143 abuts against the pin 121 so that the pin 121 performs rotational displacement. At the same time, the pin 121 links the bolt catch 122 with the second pivot shaft 5 as the center to perform the second rotational displacement movement 92 to the bolt catch position.

Figure 6:
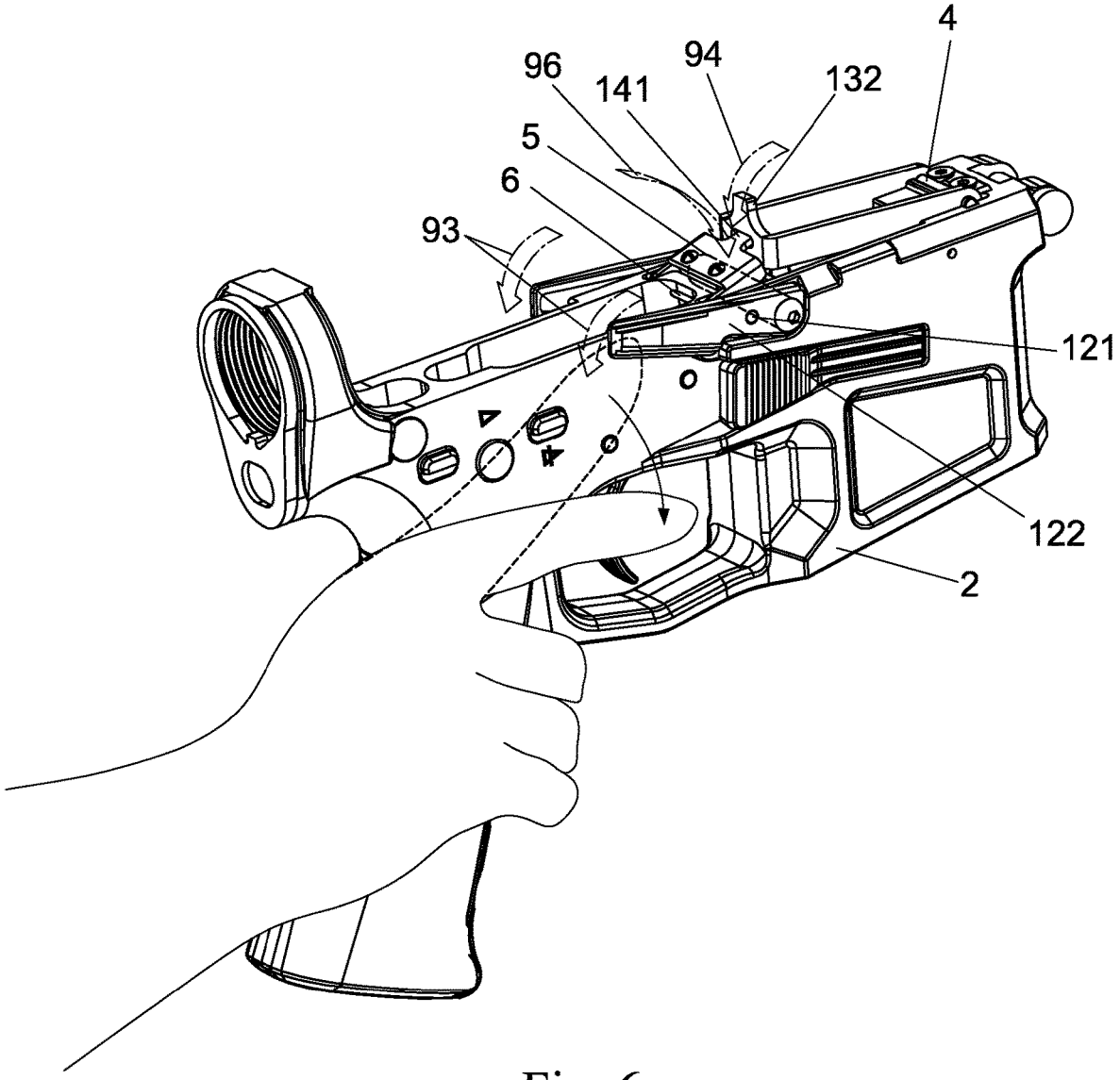
FIG. 6 is a schematic diagram of the action of the bolt catch device of the present invention when the bolt catch device is released.
Figure 7:
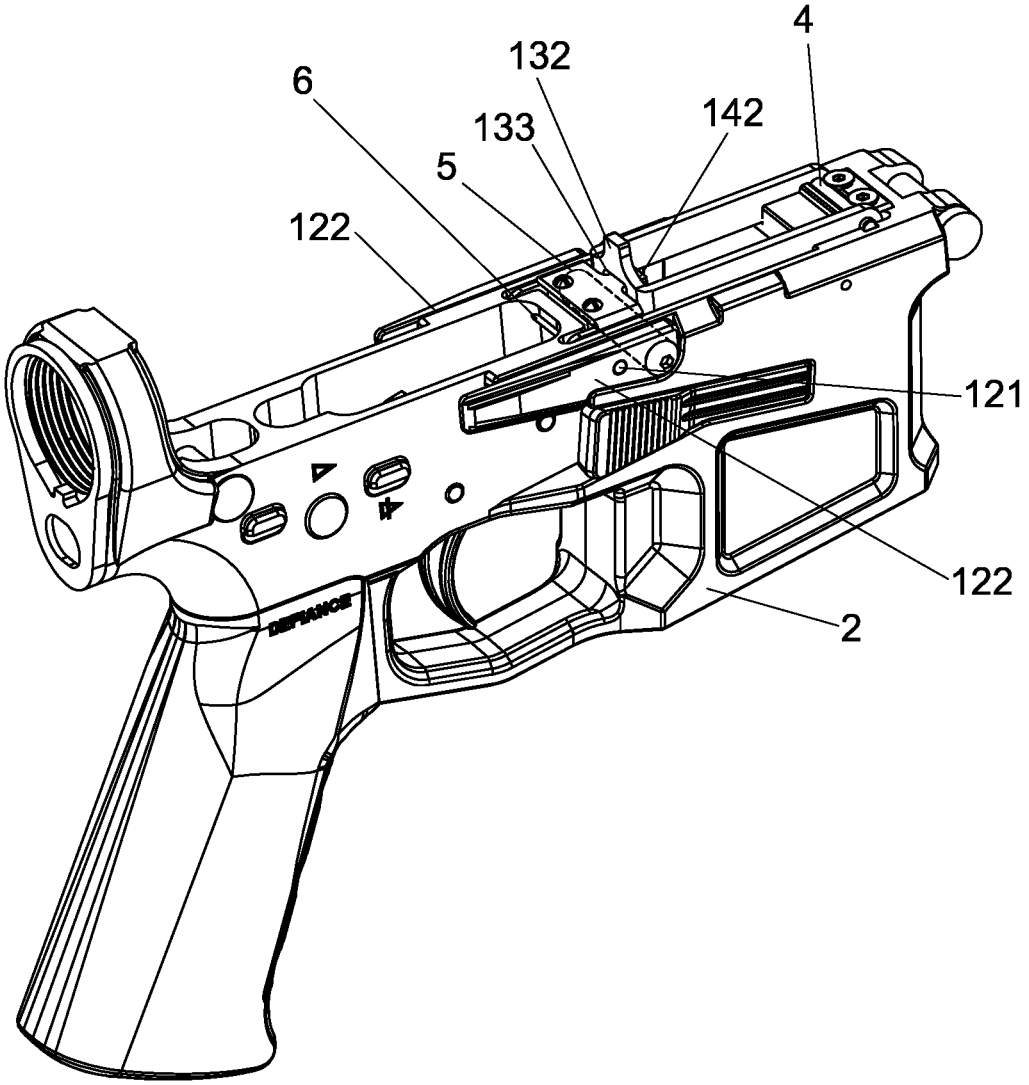
FIG. 7 is a schematic diagram of the release state of the bolt catch device of the invention.

Please refer to FIGS. 6 and 7. FIG. 6 is a schematic diagram of the action of the bolt catch device of the present invention in the release bolt catch state and FIG. 7 is a schematic diagram of the release state of the bolt catch device of the present invention. When the bolt catch 122 is toggled, the bolt catch 122 performs the third rotational displacement movement 93 with the second pivot shaft 5 from the bolt catch position to a release position. At the same time, the abutting member 132 performs a fourth rotational displacement movement 94 by the first pivot shaft 4 and moves away from the bolt 3. As a result, the bolt 3 moves and the feeding of the ammunition is made.

Further, the bolt catch 122 performs the third rotational displacement movement 93 from the bolt catch position to the release position, the pin 121 performs rotational displacement synchronously, and the pin 121 abuts against the bottom of the inner edge of the through hole 143. At the same time, the through hole 143 and the convex portion 141 perform the sixth rotational displacement movement 96 with the third pivot shaft 6 as the center, so that the convex portion 141 abuts against the bottom of the inner edge of the hole 133. At the same time, the hole 133 and the abutting member 132 perform the fourth rotational displacement movement 94 with the first pivot shaft 4 as the center, and the abutting member 132 releases the bolt 3.

That is to say, the bolt catch device 1 of the present invention only needs to use the hand that holds the grip on the gun. After replacing the exhausted magazine, move the trigger finger to the bolt catch 122. At the same time, after releasing the bolt catch state, the bolt 3 enters the ammunition loading state. Therefore, there is no need to press the bolt catch on the other side of the gun with the other hand to release the bolt catch state of the bolt and the gun is loaded with ammunition.

Figure 8:
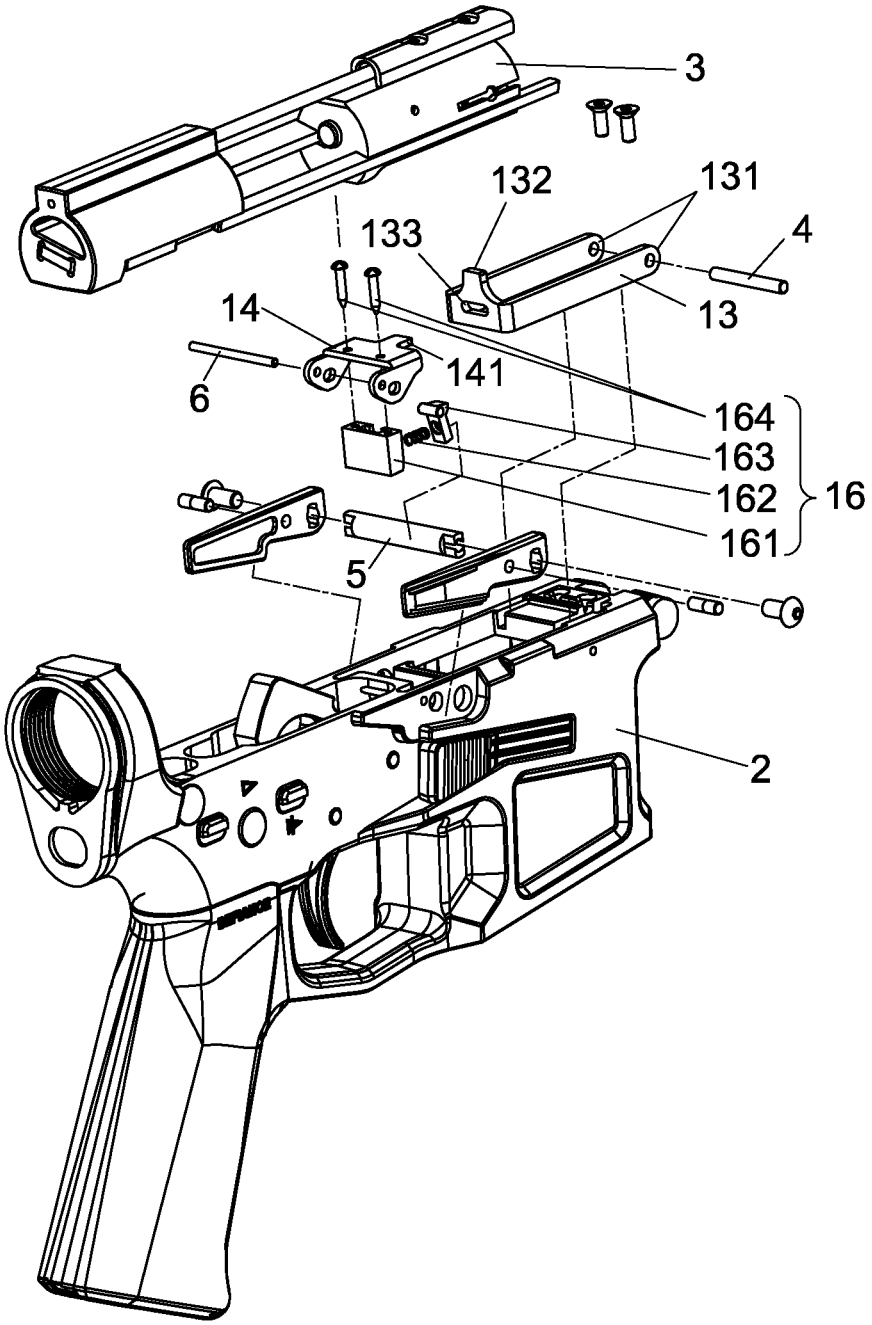
FIG. 8 is an exploded perspective view of another preferred embodiment of the present invention.

Please additionally refer to FIG. 8. FIG. 8 illustrates a further preferred embodiment in an exploded perspective schematic view. In addition, it is worth mentioning that the interlocking means, linkage device 14 further comprises a stabilizing member 16. The stabilizing member 16 is fixed to the linking means 14 at the bottom, and the stabilizing member 16 abuts against the second pivot shaft 5.

In the foregoing, the stabilizing member 16 includes a body 161, an elastic element 162, and a lever 163. The top of the body 161 is connected to the bottom of the linkage device 14, and one end of the lever 163 is pivoted to the body 161. The elastic element 162 is connected between the main body 161 and the lever 163, and the lever 163 abuts against the second pivot shaft 5. In this embodiment, the elastic element 162 is a tension spring, a compression spring, a torsion spring or a low-damping shock absorber.

When the lower housing 2 lies on a flat surface, the stabilizing member 16 stabilizes the convex portion 141 in the hole 133 to prevent the abutting member 132 of the frame body 13 from abutting against the bolt 3.

That is to say, the stabilizing member 16 enables the gun mechanism of the present invention to use the gun at a special angle. For example, when the user rolls or tilts, the frame body 13 will not spontaneously rotate, so that the abutting member 132 interferes with the operation of the bolt 3.

In addition, the stabilizing member 16 further includes at least one locking element 164, and the locking element 164 fixes the body 161 to the bottom of the linkage device 14.

In summary, the advantages of the present invention are as follows:

The bolt catch device for firearms of the present invention only needs to use the hand holding the grip of the gun and move the trigger finger after replacing the exhausted magazine, and at the same time complete the release of the bolt catch state of the gun, and the gun returns to the loaded state with the ammunition, and the ammunition can be fired.

With the stabilizing member, the bolt catch device for firearms of the present invention can allow the gun to be used at a special angle. For example, when the user rolls or tilts to shoot, the frame body will not rotate on its own, making the abutting member hinder the operation of the bolt, and causing the bolt to be set back.

The above embodiments are only used to illustrate the technical solutions of the present invention and not to limit them. Although the present invention has been described in detail with reference to the preferred embodiments, those of ordinary skill in the art should understand that the technical solutions of the present invention can be modified or modified for equivalent replacements without departing from the spirit and scope of the technical solution of the present invention.

What is claimed is:

1. A bolt catch device for firearms, connected to a lower housing and located in a moving direction of a bolt, including:

a linkage portion connected to the lower housing by a first pivot shaft and performing a first rotational displacement movement by the first pivot shaft, and the linkage portion has an abutting member; and a release portion connected with the lower housing by a second pivot shaft, wherein the release portion has a pin and a bolt catch, and both ends of the pin are respectively connected with the bolt catch and the linkage portion;

wherein the abutting member performs the first rotational displacement movement and is located in the moving direction of the bolt, and the bolt abuts against the abutting member, and at the same time, the bolt catch performs a second rotational displacement movement with the second pivot shaft and then remains in a bolt catch position;

subsequently, the bolt catch is toggled and performs a third rotational displacement movement with the second pivot shaft from the bolt catch position to a release position, and at the same time, the abutting member performs a fourth rotational displacement movement with the first pivot shaft, the abutting member leaves the bolt with the fourth rotational displacement movement, and the bolt moves to complete feeding of the ammunition.

2. The bolt catch device for firearms according to claim 1, wherein the linkage portion includes:

a frame body including a first connecting portion and the abutting member, wherein the first connecting portion is located at one end of the frame body and connected to the lower housing by the first pivot shaft, and the abutting member is located on another end of the frame body and has a hole;

a linkage device located in an accommodating groove of the lower housing and adjacent to the abutting member, wherein the linkage device includes a convex portion and a second connecting portion, the convex portion extends into the hole from one end of the linkage device, and the second connecting portion is connected with the lower housing by a third pivot shaft.

3. The bolt catch device for firearms according to claim 2, wherein the second connecting portion further includes a through hole, the release portion is located in the through hole through the pin, and the bolt catch is connected to the linkage device; and wherein the abutting member performs the first rotational displacement movement, while the convex portion performs a fifth rotational displacement movement centered on the third pivot shaft; and wherein the bolt catch performs the third rotational displacement movement, and at the same time, the convex portion performs a sixth rotational displacement movement (96) with the third pivot shaft as the center.

4. The bolt catch device for firearms according to claim 3, wherein the abutting member performs the first rotational displacement movement to a position where the bolt abuts against; and at the same time, the bottom of the inner edge of the hole abuts against the convex portion, and the convex portion performs the fifth rotational displacement movement so that the convex portion abuts against the top of the inner edge of the hole; and at the same time, the through hole performs the fifth rotational displacement movement, and the bottom of the inner edge of the through hole abuts against the pin so that the pin performs rotational displacement; and at the same time, the bolt catch performs the second rotational displacement movement to the bolt catch position.

5. The bolt catch device for firearms according to claim 3, wherein the bolt catch performs the third rotational displacement movement from the bolt catch position to the release position, the pin performs rotational displacement, and the pin abuts against the bottom of the inner edge of the through hole; and at the same time, the through hole and the convex portion perform the sixth rotational displacement movement, so that the convex portion abuts against the bottom of the inner edge of the hole; and at the same time, the hole and the abutting member perform the fourth rotational displacement movement, and the abutting member leaves the bolt.

6. The bolt catch device for firearms according to claim 2, wherein the linkage device further includes a stabilizing member, the stabilizing member is fixed to the bottom of the linkage device, and the stabilizing member abuts against the second pivot shaft; and when the lower housing lies on a side, the stabilizing member stabilizes the convex portion in the hole, preventing the abutting member of the frame body from abutting against the bolt.

7. The bolt catch device for firearms according to claim 6, wherein the stabilizing member includes a main body, an elastic element, and a lever, the top of the main body is connected to the bottom of the linkage device, and one end of the lever is pivoted on the main body, the elastic element is connected between the main body and the lever, and the lever abuts against a rotating shaft.

8. The bolt catch device for firearms according to claim 6, wherein the stabilizing member further includes at least one locking element, and the at least one locking element fixes the main body to the bottom of the linkage device.

9. The bolt catch device for firearms according to claim 8, wherein the elastic element is a tension spring, a compression spring, a torsion spring or a low-damping shock absorber.

10. The bolt catch device for firearms according to claim 1, wherein the bolt catch is connected to one end of the second pivot shaft, or the bolt catch is respectively connected to two ends of the second pivot shaft.

11. The bolt catch device for firearms according to claim 10, wherein the release portion further includes a screw, and the bolt catch further has a first hole, and one end of the second pivot shaft is located in the first hole, and the screw fastens the bolt catch and the second pivot shaft in the first hole.

* * * * *